United States Patent [19]

Albert et al.

[11] Patent Number: 5,052,496

[45] Date of Patent: Oct. 1, 1991

[54] APPARATUS FOR ATTACHING POWER TOOL HOUSING EXTENSIONS

[75] Inventors: Gregory P. Albert, Waverly, N.Y.; Bruce D. Fay, Sayre, Pa.

[73] Assignee: Ingersoll-Rand Company, Woodcliff Lake, N.J.

[21] Appl. No.: 419,710

[22] Filed: Oct. 11, 1989

[51] Int. Cl.[5] ..... B25F 1/02

[52] U.S. Cl. ..... 173/29; 173/164; 173/171; 74/417; 81/57.13; 279/46 R; 279/48; 403/370

[58] Field of Search ..... 29/560; 81/57.13, 57.29, 81/57.14; 74/417; 173/29, 46, 47, 163, 164, 171; 279/46 A, 46 R, 48, 49, 2 R, 14; 403/370, 371; 408/20, 24, 25; 409/215, 230

[56] References Cited

U.S. PATENT DOCUMENTS

| | | | |
|---|---|---|---|
| 2,589,822 | 3/1952 | Kosta | 74/417 |
| 2,795,985 | 6/1957 | Wilson | 81/57.29 X |
| 3,817,115 | 6/1974 | Schnizler et al. | 74/417 |
| 3,901,098 | 8/1975 | Jinkins | 74/417 |
| 4,422,653 | 12/1983 | Piotrowski | 279/2 R X |

*Primary Examiner*—Hien H. Phan
*Assistant Examiner*—Raymond D. Woods
*Attorney, Agent, or Firm*—Robert F. Palermo

[57] ABSTRACT

An apparatus for rapid interchange of drive head units on a power tool motor unit is provided by forming a flared lip on the first of the two housings to be connected; capturing a coupling nut behind the flare with a split clamp ring; forming a bore on the second housing into which the flared lip and clamp ring of the first housing will fit; forming a positioning stop, within the bore, against which the flared lip of the first housing will be clamped; and providing a coupling device on the second housing to which the coupling nut of the first housing will be coupled to join the two housings.

18 Claims, 1 Drawing Sheet

FIG. 1
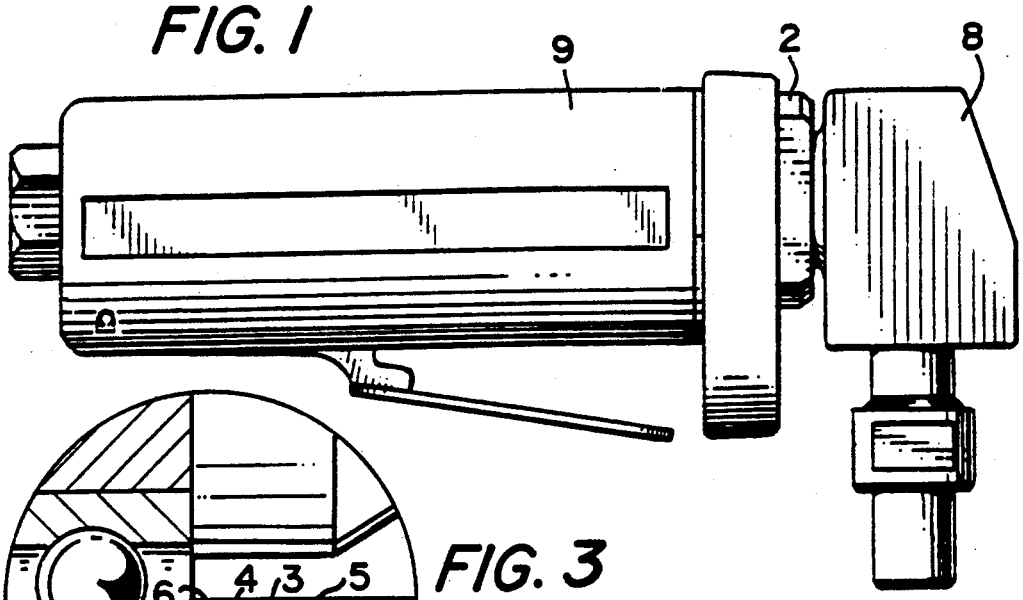
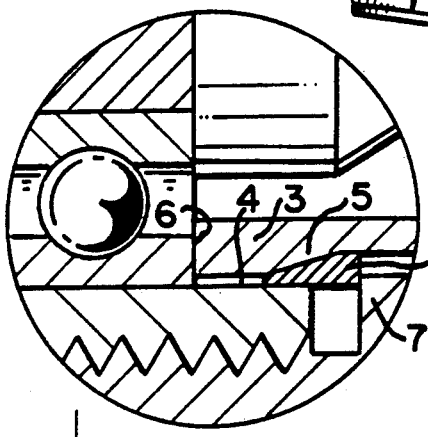
FIG. 3
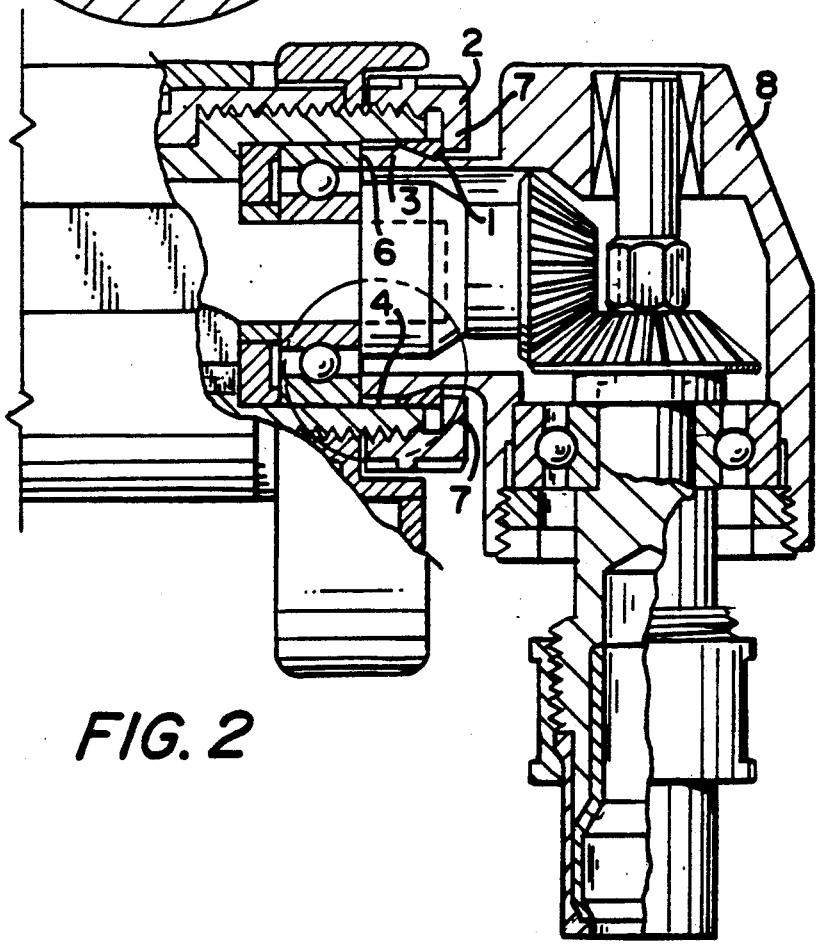
FIG. 2

APPARATUS FOR ATTACHING POWER TOOL HOUSING EXTENSIONS

BACKGROUND OF THE INVENTION

This invention relates to power tools and, in particular, to an apparatus for attaching a drive head to the power unit of a tool for driving different accessories, such as nut sockets, fasteners, drill bits, or grinding, sanding, and buffing attachments.

During assembly of complex mechanical systems, it is necessary to use different types of tools for the different fasteners. This situation is dealt with by having an assortment of power tools available which are suitable for any assembly situation. This can be quite expensive, however, and another approach has been to have interchangeable drive heads, as needed, for use on a common power unit. There have been several interchange systems of varying practicality.

One interchange system which requires no separable parts has been in use for a number of years. In this case, the motor housing has splines on its inside diameter which mate with splines on the outside diameter of the drive head. A split clamp ring having a circular cross section is located behind the drive head splines and has a large enough outside diameter to retain a coupling nut. When attaching the head, the coupling nut is threaded to the motor housing. This draws the clamp ring against the splines of the drive head and axially clamps it against the motor housing. This works quite well, but it does have the disadvantages of the cost of machining splines on both housings, of only providing line contact between the clamping members, and of being restricted to angular orientation increments which are dictated by the number of splines and the spline design chosen.

Another interchange system which has been in use by Ingersoll-Rand for several years eliminates the orientation limitations of the previously described system. The drive head housing has a flared end behind which is a coupling nut and a retaining ring having a round cross section. The flare on the drive head has no splines in this case; therefore, this system provides for universal orientation of the drive head with respect to the axis of the motor unit.

Both of the foregoing systems work very well within their limitations. However, both systems share a common shortcoming which is attributable to the round cross section of the retaining ring employed in both cases. When the coupling nut is engaged with the threads on the motor housing and drawn up tight, the retaining ring is trapped between the flare on the drive head and the coupling nut flange. This results in a straight compressive clamping force which is oriented on the diameter of the circular cross section of the ring. This line contact is adequate when the connection is first made; however, during handling of the tool in use, the clamping force decreases and the head becomes loose and requires retightening.

The foregoing limitations present inconvenience associated with routine use of power tools. It would be desirable to provide an alternative attachment method to attach the drive head to the motor housing in such a manner as to avoid the inconvenience and cost of the previously described methods. Accordingly, a suitable alternative is provided which includes features which will be more fully discussed hereinafter.

SUMMARY OF THE INVENTION

In one aspect of the present invention, this is accomplished by providing a flared lip on one of the housings behind which is a threaded coupling nut which is retained by a split clamp ring; a bore on the second housing to receive the flare and clamp ring of the first housing; and threads on the second housing to engage with the coupling nut to join the two housings.

This is provided in such a way as to incorporate the benefits of the two previously described commonly used systems, while avoiding the limitations which are presented by either or both of those systems. The foregoing and other aspects will be more readily understood by reference to the accompanying specification and drawings. It is to be expressly understood, however, that the drawing figures are not intended as a definition of the invention but are for the purpose of illustration only.

BRIEF DESCRIPTION OF THE DRAWINGS

FIG. 1 is an overall view of a power tool illustrating the tool motor housing connected to an angle drive head housing.

FIG. 1A is a fragmentary view of a tool motor housing connected to a straight drive head housing.

FIG. 2 is an enlarged fragmentary partial sectional view of the tool showing the coupling mechanism connecting the drive head housing to the tool motor housing.

FIG. 3 is a further enlargement showing the details of the coupling mechanism which is illustrated in FIG. 2.

FIG. 3A is a view, as in FIG. 3, showing an alternative embodiment of the coupling mechanism of the present invention.

DESCRIPTION OF THE PREFERRED EMBODIMENT

FIG. 1 shows a motor housing 9 connected to a drive head housing 8 by a coupling nut 2. This is only one of many possible tool and motor combinations to which the present invention may apply.

FIG. 1A illustrates coupling of a motor housing 9 to a straight drive head housing 8.

In FIG. 2, details of the angle head power output to the tool holder are shown as well as the critical details of the present invention. These details are further magnified in FIG. 3.

Also, in FIG. 3A are shown details of an alternative coupling arrangement in which the flared lip 3 and the sleeve bore 4 are provided on the alternative housings.

Referring now to FIGS. 2 and 3, a front rotor bearing 6 supports a motor output shaft and serves as a stop against which the drive head housing 8 can be firmly clamped. The drive head housing contains a bevel gear arrangement which transmits motor output shaft power to a drive shaft to turn the tool holding collet.

Examining the drive head housing 8, it can be seen that a housing lip 3 is formed as a flared thick walled section of the housing and has a bevel 5 which defines the axial dimension of the housing lip 3. A beveled split clamp ring 1 has its bevel on the inside to mate with the drive head housing bevel 5.

The coupling nut 2 has a flange 7 which presses against the beveled split clamp ring 1 when the coupling nut 2 is threaded on the motor housing 9. As the coupling nut 2 advances on the threads of the motor housing 9, the coupling nut flange 7 pushes the beveled split clamp ring 1 so that it rides up the bevel 5 on the drive head housing 8. Only a very slight movement is possible before the clamp ring 1 makes contact with the motor housing sleeve bore 4. When snugly tightened, flange 7 on coupling nut 2 is elastically deformed in much the same manner as a domed spring washer. This maintains the clamping force so that it is not necessary to periodically retighten the connection. Because of the bevel to bevel to bore relationship between the clamp ring 1, the housing lip 3, and the housing sleeve bore 4, there are very strong clamping forces generated by the threading of coupling nut 2 onto the motor housing 9. This is due to the large contact surface areas of the clamping members in this arrangement and to the wedging action caused by the cooperating bevels.

This connection design permits complete freedom of rotation of the drive head with respect to the motor until the coupling nut is tightened. In addition, because of this design, the drive head is always precisely centered and aligned with the axis of the motor housing.

The foregoing describes a simple and low cost connecting means for attaching interchangeable drive heads to motor units of power tools. Moreover, despite its simplicity and economy, the connector means permits infinite orientation adjustment about the motor housing axis. It also provides positive clamping force to secure the driving head against radial, axial and rotary motions.

This has been accomplished without resorting to splines, slots, notches, and multiple threaded connecting parts. Further, since there are no separable parts, the risk of losing attachment parts is nil.

While this invention has been illustrated and described in accordance with the preferred embodiment, it is recognized that variations may be made therein by those skilled in the art.

For example, FIG. 3A shows one alternative embodiment of the invention. By simply reversing the arrangement between the drive head housing 8 and the motor housing 9, the flared housing lip 3, the coupling nut 2, and the clamp ring 1 would be carried on the motor housing 9 instead of on the drive head housing 8. This would provide the economy of only requiring one nut 2 and clamp ring 1 per motor, regardless of how many drive heads are needed. Another modification which suggests itself is to replace the threads on the outside of the one housing and on the inside of the coupling nut with an interrupted screw or other quick connect type of arrangements as are commonly available in the fastening industry.

This and other variations are within the scope and spirit of this invention as set forth in the claims.

We claim:

1. An apparatus for attachment of a drive head housing to a motor housing in a power tool, comprising:

a rigid flared lip on a first housing;

a coupling nut which slides over said flared lip;

a split rigid clamp ring which, when placed over the flared lip on said first housing, retains said coupling nut on said first housing;

a rigid sleeve bore means on a second housing into which said rigid flared lip and said split rigid clamp ring are inserted; and means on said second housing to which the coupling nut is attached to secure the first housing to the second housing of the tool.

2. The apparatus according to claim 1, wherein a flange on the coupling nut is so formed that, when it is formed against the clamp ring, it elastically deforms and thus maintains a constant clamping pressure on the housings due to the resulting elastic stress.

3. The apparatus according to claim 1, wherein the rigid sleeve bore means is formed so that it makes a sliding fit with the rigid flared lip on the first housing.

4. The apparatus according to claim 1, wherein the rigid flared lip on the first housing and split rigid clamp ring have cooperating bevels on their outside diameter and inside diameter, respectively, to create a wedging action when forced together within the rigid sleeve bore means on the second housing.

5. The apparatus according to claim 1, wherein the first housing is the drive head housing, and the second housing is the motor housing.

6. The apparatus according to claim 1, wherein the firs housing is the motor housing, and the second housing is the drive head housing.

7. A power tool, comprising:

a motor housing;

a drive head in a housing;

a flared lip means on the drive head housing and a sleeve bore means on the motor housing;

a coupling nut having internal coupling means and featuring an inside flange at one end, which is capable of sliding over the flared lip means;

a split clamp ring which, when stretchably placed over the flared lip means, retains the coupling nut on the housing; and external coupling means on the motor housing upon which the coupling nut is attached so that said inside flange forces the split clamp ring against the flared lip means causing it to wedgeably clamp the flared lip means within the sleeve bore means.

8. The power tool according to claim 7, wherein the drive head housing has the sleeve bore means and the motor housing has the flared lip means.

9. The power tool according to claim 7, wherein the flange on the coupling nut is so formed that, when it is forced against the clamp ring, it elastically deforms and thus maintains constant clamping pressure on the housings due to the resulting elastic stress.

10. The power tool according to claim 7, wherein the split clamp ring has a bevel on an inside surface which corresponds to a bevel on an outside surface of the flared lip means.

11. A power tool motor housing for use with a drive head, comprising:

a rigid flared lip on an end of the motor housing to which the drive head is mounted;

a coupling nut, featuring an inside flange at one end, which is capable of sliding over the rigid flared lip on the motor housing; and a split rigid clamp ring which, when stretchably placed over the rigid flared lip of the motor housing, retains the coupling nut on the motor housing.

12. The motor housing according to claim 11, wherein the flange on the coupling nut is so formed that, when it is forced against the clamp ring, it elastically deforms and thus maintains a constant clamping pressure on the housing due to the resulting elastic stress.

13. The motor housing according to claim 11 wherein the rigid flared lip and split rigid clamp ring have cooperating bevels on their outside diameter and inside diameter, respectively, to create a wedging action when forced together within a rigid sleeve bore of a drive head housing.

14. A drive head unit for a power tool, comprising:

a drive head housing;

a rigid sleeve bore means on said drive head housing;

external coupling means on said drive head housing at said rigid sleeve bore means which will be engaged by an internal coupling means of a coupling nut on a motor housing;

an internal positioning stop means within said rigid sleeve bore means, against which a flared lip means of said motor housing will seat when said two housings are clamped together; and a split clamp ring which, when stretchably placed over said flared lip means of said motor housing, retains said coupling nut on said motor housing.

15. A power tool motor unit for use with interchangeable drive heads, comprising:

a motor housing;

a rigid sleeve bore means at an end of the motor housing which connects to a mating drive head housing;

external coupling means on the rigid sleeve bore means for engagement with a coupling nut on said mating drive head housing;

a forward rotor bearing which serves as a positioning stop for said drive head when it is clamped into the sleeve bore means of said motor housing; and a split clamp ring which, when stretchably placed over a flared lip means of said motor housing, retains said coupling nut on said motor housing.

16. A drive head unit for a power tool, comprising:

a drive head encased in a drive head housing;

a flared lip means on a power input end of said drive head housing;

a coupling nut having internal coupling means and featuring an inside flange at one end, which is capable of sliding over said flared lip means; and a split clamp ring which, when stretchably placed over the flared lip means, retains said coupling nut on the housing.

17. The drive head according to claim 16, wherein the flange on the coupling nut is so formed that, when it is forced against the clamp ring, it elastically deforms and thus maintains a constant clamping pressure on the housing due to the resulting elastic stress.

18. The drive head unit according to claim 16, wherein the flared lip means and split clamp ring have cooperating bevels on their outside diameter and inside diameter, respectively, to create a wedging action when forced together within a sleeve bore of a motor housing of said power tool.

* * * * *